United States Patent [19]

Curtiss, Jr.

[11] 4,364,501

[45] Dec. 21, 1982

[54] DISPENSER FOR ROLL OF TICKETS IN STRIP FORM

[75] Inventor: John S. Curtiss, Jr., Belmont, Calif.

[73] Assignee: Instrumental Products, Redwood City, Calif.

[21] Appl. No.: 216,195

[22] Filed: Dec. 15, 1980

[51] Int. Cl.[3] ..... B26D 1/02

[52] U.S. Cl. ..... 225/13; 225/19; 225/88; 225/90

[58] Field of Search ..... 225/13, 12, 19, 88, 225/90

[56] References Cited

U.S. PATENT DOCUMENTS

| | | | |
|---|---|---|---|
| 1,112,501 | 10/1914 | Walsh | 225/12 |
| 1,239,981 | 9/1917 | Storm | 225/13 X |
| 1,332,194 | 3/1920 | Arcus | 225/13 |

FOREIGN PATENT DOCUMENTS

| | | | |
|---|---|---|---|
| 6065 | of 1913 | United Kingdom | 225/13 |
| 387730 | 2/1933 | United Kingdom | 225/13 |

*Primary Examiner*—Frank T. Yost

*Attorney, Agent, or Firm*—Flehr, Hohbach, Test, Albritton & Herbert

[57] ABSTRACT

An assembly for dispensing tickets in strip form from a roll thereof registers a cutting blade with respect to drive openings in the strip of tickets, the drive openings occuring at the opposite ends of each ticket.

4 Claims, 2 Drawing Figures

FIG. 1
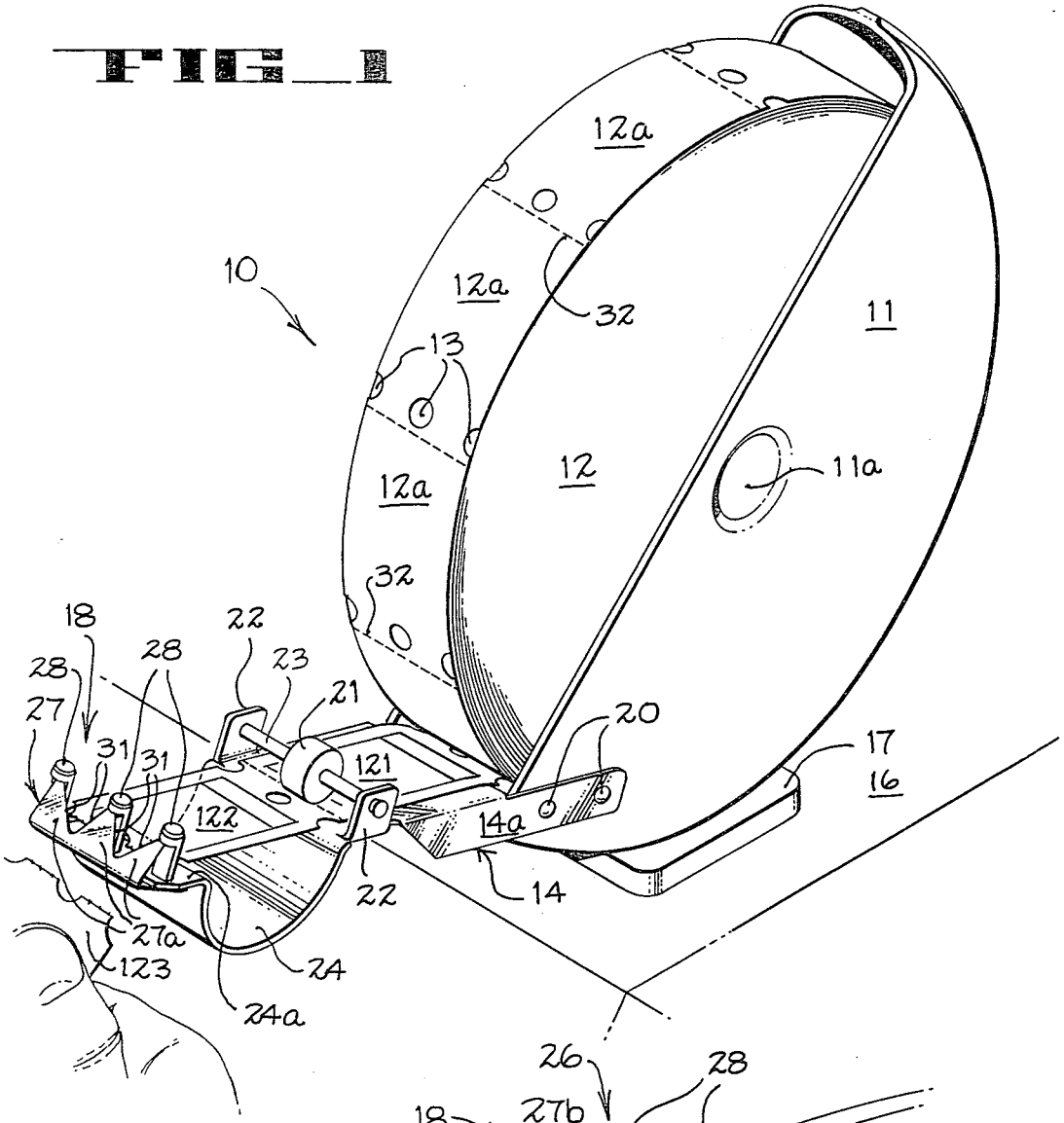
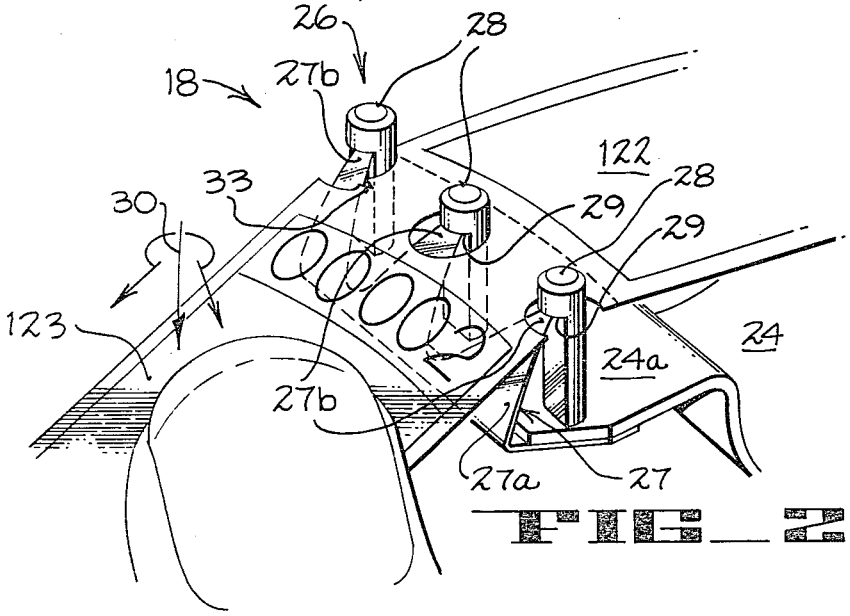
FIG. 2

DISPENSER FOR ROLL OF TICKETS IN STRIP FORM

This invention pertains to apparatus for dispensing a roll of tickets or the like in strip form and more particularly to such a ticket dispenser characterized by improved means for more accurately severing one ticket from the next.

As used herein, the term "ticket" is deemed to include markers, slips, cards, and the like useful for various purposes.

It has been observed that in a typical roll of tickets in strip form each adjacent pair of tickets is separated by a perforated line of weakness which in some instances includes a plurality of openings, typically used for engaging a drive sprocket or the like for advancing the ticket. Typically, it is intended that the line of weakness should intersect the plurality of sprocket holes so that the tickets separate readily along the line of weakness. Thus, to provide tickets wherein the sprocket openings and line of weakness coincide involves substantial additional cost. Accordingly, less expensive rolls of tickets in strip form frequently dispose the sprocket (drive) openings at positions offset from the line of weakness separating adjacent tickets.

It has further been observed that the provision of the sprocket openings is usually relatively accurate with respect to the spacing between adjacent tickets. Accordingly, as disclosed herein there is provided an improved ticket dispensing assembly wherein the cheaper tickets as described above can be readily used in place of the more expensive tickets.

In general there has been provided a ticket dispenser assembly for delivering tickets in strip form from a roll thereof wherein the tickets are of a type having openings therethrough disposed between successive tickets. The dispenser assembly comprises means for supporting a roll of such tickets to rotate in response to withdrawal of each ticket therefrom. Further, means forming a ticket guiding and dispensing unit defines a path for delivery of tickets including means forming a cutting assembly at the dispensing end of the path. The cutting assembly includes a blade for cutting through a ticket and means for penetrating the openings between successive tickets to restrain the strip of tickets as the leading ticket is drawn against the blade so as to separate the leading ticket from a waiting ticket therebehind. A first station retains a ticket against the surface of the path while a second station supports a waiting ticket between the penetrating means and the first station. The waiting ticket is substantially unobstructed from both above and below so as to readily permit the waiting ticket to be engaged between a person's thumb and index finger for lifting and advancing the waiting ticket along the path to dispose openings between a pair of successive tickets onto the penetrating means.

It is a general object of the present invention to provide a substantially improved ticket dispensing assembly.

Another object of the present invention is to provide a ticket dispensing assembly characterized by a cutting assembly wherein strips may be separated substantially without regard to the location of the line of weakness which normally is provided between adjacent tickets.

The foregoing and other objects of the invention will become more readily evident from the following detailed description of a preferred embodiment when considered in conjunction with the drawings.

FIG. 1 shows a diagrammatic perspective view of a ticket dispensing assembly according to the invention; and FIG. 2 shows an enlarged perspective view of the cutting and penetrating assembly shown in FIG. 1.

A ticket dispenser assembly 10 comprises a casing 11 of suitable material such as semi-rigid plastic formed with inwardly confronting circular lug portions 11*a* on opposite sides of the casing 11 for supporting a roll 12 of tickets 11*a* of a type having drive openings 13 therethrough disposed between successive tickets 12*a*.

Assembly 10 is of a type, for example, as can be used in a store wherein each customer takes a given number in sequence and the customers are then served in the order of the numbering on the tickets. Thus, for example, a counter top 16 serves to support the base 17 of casing 11 for supplying tickets to the customers. A ticket guiding and dispensing unit 14 defines a path for delivery of tickets including a cutting assembly 18 at the dispensing end of the path. A bracket 14*a* riveted to casing 11 by the rivets 20 serves to support unit 14 therefrom.

The upper surface 19 of bracket 14*a* provides a panel across which the strip of tickets 12*a* is delivered. Rolling guide 21 retains a ticket 121 loosely against panel 19.

Bracket 14*a* includes a pair of upwardly extending ears 22 for supporting an axle 23 at its opposite ends. Guide 21 can be loosely mounted upon axle 23 to permit rolling guide 21 to rotate about axle 23.

Roller 21 rides reasonably loosely upon the upper surface of the strip of tickets being discharged in order to provide proper feeding of the tickets by retaining the ticket therebeneath against panel 19 forming the upper surface of the ticket path.

Means forming a station for supporting a "waiting" ticket extends forwardly and includes a semi-cylindrical support member 24 providing clearance beneath a waiting ticket 122. Thus, as disclosed the waiting ticket 122 is presented to a customer substantially unobstructed both from above and below so as to readily permit the ticket to be engaged between a person's thumb and index finger when lifting and advancing the waiting ticket along the path for dispensing tickets.

A cutting assembly 18 in conjunction with a penetrator assembly 26 serves to restrain the leading ticket 123 so that a customer, for example, can sever the leading ticket 123 from the waiting ticket 122 while at the same time isolating the forces applied to sever the leading ticket 123 from advancing roll 12.

Thus, as shown best in FIG. 2, cutting assembly 18 includes a plurality of posts or pegs 28 disposed to extend substantially normal to the plane of ticket 122 for penetrating the openings 13 as defined between successive tickets. A notch 29 formed in the downstream side of each of the posts or pegs 28 serves to engage the tips 27*b* of triangularly shaped teeth 27*a* of the cutting blade 27 carried adjacent pegs 28. Blade 27, made of thin, resilient steel includes a pair of adjacent V-shaped cutting blades 31 whereby the leading ticket 123 can be drawn in any of the directions indicated by arrows 30, or variously therebetween, and the leading ticket will be readily severed from the waiting ticket 122.

Thus, severing commences at the periphery of openings 13 (as at 33) whereby the triangular teeth wedge themselves through openings 13 while cutting into the periphery thereof at the same time.

The pointed ends 27b of teeth 27a extend rearwardly of the direction of movement of the tickets. Each of the teeth 27a are of a yielding material to be bent upwardly and rearwardly to be held in an associated one of the notches 29 for holding the pointed end of an associated one of the teeth 27a disposed in a cutting position.

Thus, it will be readily evident that adjacent V-shaped cutting edges 31 disposed adjacent pegs 28 serve to engage and sever the leading ticket 123 from the waiting ticket 122 as pegs 28 register with openings 13. Accordingly, the misprinting of a line of weakness 32 with respect to a center line taken through laterally adjacent openings 13 as shown herein becomes irrelevant inasmuch as the tickets will be severed in alignment with pegs 28. Note, for example, the commencement of severing of the material at point 33 adjacent the left hand peg 28 in FIG. 2.

As thus arranged, cutting assembly 18 includes a plurality of pegs 28 for penetrating drive openings 13 between successive tickets. The forward lip 24a of member 24 supports pegs 28 as well as cutting blade 27.

Accordingly, as described above there has been provided an improved ticket dispensing assembly 10 wherein the accuracy of the registration of the usual line of weakness 32 with respect to a common center line extending laterally across the tickets taken through the center of openings 13 becomes substantially irrelevant whereby cheaper rolls of tickets in strip form can be employed without loss of accuracy.

In addition, it is to be noted that when the leading ticket 123 is severed by a customer pulling upon the ticket, such pulling forces remain isolated from roll 12 by means of the posts or pegs 28 so as not to advance the roll.

From the foregoing it will be readily evident that there has been provided an improved ticket dispenser assembly for delivering tickets in strip form from a roll thereof.

I claim:

1. A ticket dispenser assembly for delivering tickets in strip form from a roll thereof, the tickets being of a type having openings therethrough disposed between successive tickets, said dispenser comprising means for supporting a roll of such tickets to rotate in response to withdrawal of each ticket therefrom, means forming a ticket guiding and dispensing unit defining a path for delivery of tickets including means forming a cutting assembly at the dispensing end of said path, said cutting assembly including a plurality of pegs for penetrating the openings between successive tickets, means supporting said pegs, a cutting blade carried by the last named means and formed to include a plurality of teeth corresponding in number substantially to the number of said pegs, said teeth pointing rearwardly of the direction of movement of the tickets, to restrain the strip of tickets as the leading ticket is drawn against said blade to separate said leading ticket from a waiting ticket therebehind, means forming a first station for retaining a ticket against the surface of the path, means forming a second station supporting a waiting ticket between said penetrating means and said first station, the last named means serving to dispose said waiting ticket substantially unobstructed from both above and below to readily permit the ticket to be engaged between a person's thumb and index finger when lifting and advancing the waiting ticket along said path to dispose openings between a pair of successive tickets onto said pegs.

2. A ticket dispenser assembly for delivering tickets in strip form from a roll thereof, the tickets being of a type having openings therethrough disposed between successive tickets, said dispenser comprising means for supporting a roll of such tickets to rotate in response to withdrawal of each ticket therefrom, means forming a ticket guiding and dispensing unit defining a path for delivery of tickets including means forming a cutting assembly at the dispensing end of said path, said cutting assembly including blade means for cutting through a ticket and means for penetrating the openings between successive tickets to restrain the strip of tickets as the leading ticket is drawn against said blade means to separate said leading ticket from a waiting ticket therebehind, means forming a first station for retaining a ticket against the surface of the path, means forming a second station supporting a waiting ticket between said penetrating means and said first station, the last named means serving to dispose said waiting ticket substantially unobstructed from both above and below to readily permit the ticket to be engaged between a person's thumb and index finger when lifting and advancing the waiting ticket along said path to dispose openings between a pair of successive tickets onto said penetrating means, said cutting means being characterized by a plurality of pegs disposed to extend substantially normal to the plane of tickets moving along said path for penetrating the openings defined between successive tickets, a notch formed in said pegs on the downstream side thereof, means supporting said pegs, a cutting blade carried adjacent said pegs and formed to include a plurality of triangularly shaped teeth in numbers not substantially in excess of the number of said pegs, said teeth being disposed to be pointed rearwardly of the direction of movement of the tickets, each said tooth being of a yielding material to be bent upwardly and rearwardly to engage an associated one of said notches for holding the pointed end of an associated one of said teeth disposed in a cutting position.

3. In a ticket dispenser assembly for dispensing tickets in strip form from a roll thereof, the tickets being of a type having openings therethrough disposed between successive tickets, said dispenser comprising means for supporting a roll of such tickets to rotate in response to withdrawal of each ticket therefrom, means forming a ticket guiding and dispensing unit defining a guide path for the passage of tickets therealong, said guide path including a ticket support station for receiving one of a strip of tickets, a cutting assembly disposed along said path and displaced from the last named means substantially the length of a ticket, a plurality of pegs disposed to extend substantially normal to the plane of tickets moving along said path for penetrating said openings and restraining the leading end of a waiting ticket from movement along said path, means supporting said pegs, a cutting blade carried adjacent said pegs and formed to include a plurality of triangularly shaped teeth associated with said pegs, said teeth being disposed to be pointed rearwardly of the direction of movement of the tickets, each said tooth extending upwardly and rearwardly to be disposed in a cutting position whereby as the leading ticket is drawn forwardly continued forward movement of the leading ticket against said cutting means serves to sever same from the others.

4. In a ticket dispenser assembly for dispensing tickets in strip form from a roll thereof, the tickets being of a type having openings therethrough disposed between successive tickets, said dispenser comprising means for supporting a roll of such tickets to rotate in response to withdrawal of each ticket therefrom, means forming a ticket guiding and dispensing unit defining a guide path for the passage of tickets therealong, a cutting assembly disposed along said path including means for penetrating said openings and formed to restrain the leading end of a waiting ticket from movement along said path, cutting blade means having a plurality of upwardly and rearwardly disposed tapered teeth, the upper end of said teeth being disposed proximate said penetrating means, a portion of said path upstream of said cutting assembly being formed to provide a substantially unobstructed clearance above and beneath the waiting ticket to permit the waiting ticket to be readily engaged between a person's thumb and index finger, said path permitting the waiting ticket to be lifted and drawn forwardly to dispose openings following same onto said means for penetrating the openings to restrain the strip of tickets in a position so that continued forward movement of the leading ticket draws said strip against said cutting blade means to sever said leading ticket from said strip.

* * * * *